US009010535B1

(12) United States Patent
Wolf et al.

(10) Patent No.: US 9,010,535 B1
(45) Date of Patent: Apr. 21, 2015

(54) PILLBOX FOR A CELLULAR PHONE HAVING A PORT

(71) Applicant: Walgreen Co., Deerfield, IL (US)

(72) Inventors: Michael R. Wolf, Elmwood Park, IL (US); Steven Gudenkauf, Cary, IL (US)

(73) Assignee: Walgreen Co., Deerfield, IL (US)

( * ) Notice: Subject to any disclaimer, the term of this patent is extended or adjusted under 35 U.S.C. 154(b) by 0 days.

(21) Appl. No.: 13/874,057

(22) Filed: Apr. 30, 2013

(51) Int. Cl.
*B65D 83/04* (2006.01)
*A61J 1/03* (2006.01)

(52) U.S. Cl.
CPC ..... *A61J 1/03* (2013.01)

(58) Field of Classification Search
USPC ..... 206/37, 38, 528–540, 320; 361/679.01–679.03, 679.55–679.59; 455/575.1–575.8
See application file for complete search history.

(56) References Cited

U.S. PATENT DOCUMENTS

| | | | | |
|---|---|---|---|---|
| 6,471,063 | B2 * | 10/2002 | Stepp | 206/530 |
| 7,337,899 | B2 * | 3/2008 | Sterns | 206/320 |
| 8,322,528 | B2 * | 12/2012 | Sterns | 206/320 |
| 8,342,325 | B2 * | 1/2013 | Rayner | 206/320 |
| 8,393,466 | B2 * | 3/2013 | Rayner | 206/320 |
| 8,526,180 | B2 * | 9/2013 | Rayner | 361/679.55 |

* cited by examiner

*Primary Examiner* — Byron Gehman
(74) *Attorney, Agent, or Firm* — Marshall, Gerstein & Borun LLP; Francis C. Kowalik; Randall G. Rueth

(57) ABSTRACT

A pillbox for a cellular phone having a port or socket is disclosed which includes a body portion for one or more pills, a closure portion for closing the body portion, and an attachment portion for insertion into the port or socket of the cellular phone.

21 Claims, 2 Drawing Sheets

PILLBOX FOR A CELLULAR PHONE HAVING A PORT

TECHNICAL FIELD

The present disclosure relates generally to a container for receiving and transporting pills and, more particularly, to a pillbox configured to hold one or more pills wherein the pillbox is adapted for association with a cellular phone.

BACKGROUND

A pillbox is a special container for storing scheduled doses of a patient's medications during the course of a certain time interval. In one form, a pillbox may take the form of an organizer which may typically have square shaped compartments for each day of the week, although other discreet forms have come to market in recent times, including cylindrical and pen-shaped cases. Pillboxes including those in the form of an organizer are viewed as a way to prevent or reduce medication errors on the part of the patient.

Pill organizers are useful for many patients including the elderly or those with memory deficiencies as well as those taking multiple medications as an aid in remembering to take proper timely doses of their medications. They allow a patient to know whether they have taken a particular dose of their medication since a pill remaining in its compartment visually indicates that it has not been taken whereas a missing pill likely has been taken.

Pill organizers often have various features that make them easier to use for those with special needs such as color-coding, braille for the blind, or a locking mechanism to prevent double dosing.

While there are many different types of pill organizers available to suit a variety of requirements, they tend to be relatively large in size making them less than ideal for busy patients who enjoy normal mobility. For such patients, it is not at all uncommon for them to be attending a doctor's appointment, going shopping, working out of the home, etc., where it is not practical to carry a large pill organizer in order to have medication available.

For busy, mobile patients who find it impractical to carry any of the available types of pill organizers with them at all times as they go through their normal daily routines, it is nonetheless important to have their medication available even during those times when they are out of the home in order to ensure strict compliance with a prescribed medication regimen.

BRIEF SUMMARY

The present disclosure is directed to providing a suitable manner for patients who frequently leave the home to a have their medication available so it can be taken at the prescribed time without having to carry a large pill organizer. In an exemplary embodiment, a pillbox for a cellular phone having a port or socket is provided which comprises a body portion for one or more pills. The pillbox has a closure portion, which may comprise a cover member or lid, for opening and closing the body portion, which may comprise a container, and it also has an attachment portion, which may comprise a projection, for insertion into a port or socket of a cellular phone.

Preferably, the body portion or container has a side wall and a bottom wall with the attachment portion or projection extending from the side wall of the container. With this construction, the closure portion or lid advantageously has a top wall and a side wall wherein the lid side wall is suitably configured to close the container by engaging the container side wall. In one embodiment, a living hinge serves to operatively connect the side walls of the lid and the container for closing and opening the container.

Advantageously, a finger latch may be operatively associated with the side walls of the container and the lid on corresponding side wall segments opposite to the living hinge, and the entire pillbox including the container and lid may be molded of a plastic material to be generally rectangular in shape with the projection being generally cylindrical.

Other advantages and features of the present disclosure will be appreciated from a consideration of the detailed description below taken in conjunction with the accompanying drawings.

DETAILED DESCRIPTION

It should be understood that, unless a term is expressly defined herein using the sentence "As used herein, the term '_____' is hereby defined to mean . . . " or a similar sentence, there is no intent to limit the meaning of that term, expressly or by implication, beyond its plain or ordinary meaning. Thus, any term not expressly defined herein should not be interpreted to be limited in scope based on any statement herein (other than the express language of the claims); moreover, to the extent that any term recited in the claims is referred to herein in a manner consistent with a single meaning, that is done for the sake of clarity only so as to not confuse the reader, and it is not intended that such claim term be limited, by implication or otherwise, to that single meaning. Finally, unless it is the case that a claim element is defined by reciting the word "means" and an accompanying stated function without the recital of any structure, it is not intended that the scope of any claim element be interpreted based on the application of 35 U.S.C. §112, sixth paragraph.

Figure 1:
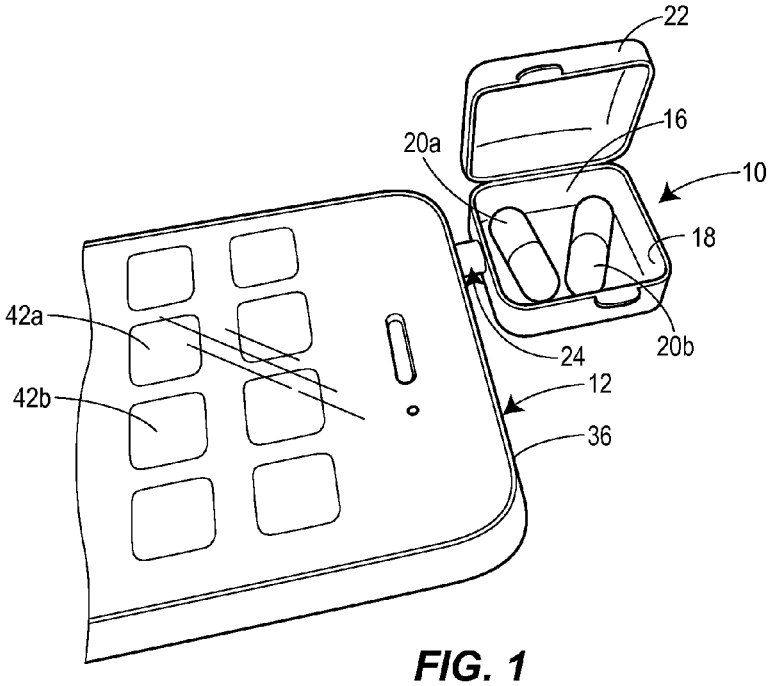
FIG. 1 is a perspective view of a pillbox mounted on a cellular phone in accordance with the present disclosure.
Figure 2A:
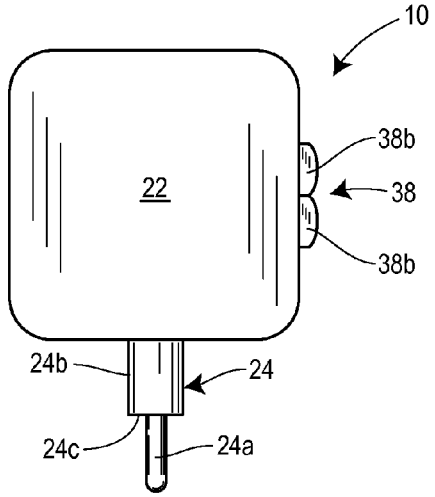
FIG. 2A is a top plan view of the pillbox of FIG. 1 after removal from the cellular phone and in a closed position.
Figure 2B:
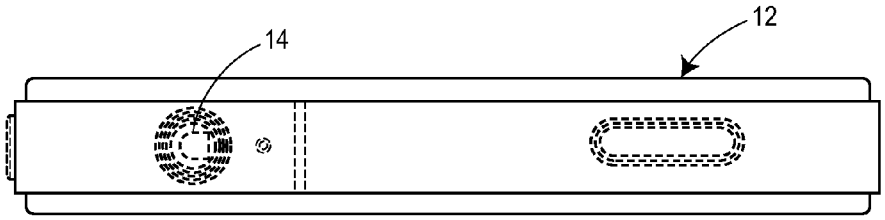
FIG. 2B is a peripheral edge view of the cellular phone of FIG. 1 illustrating a port or socket for receiving a projection.
Figure 3:
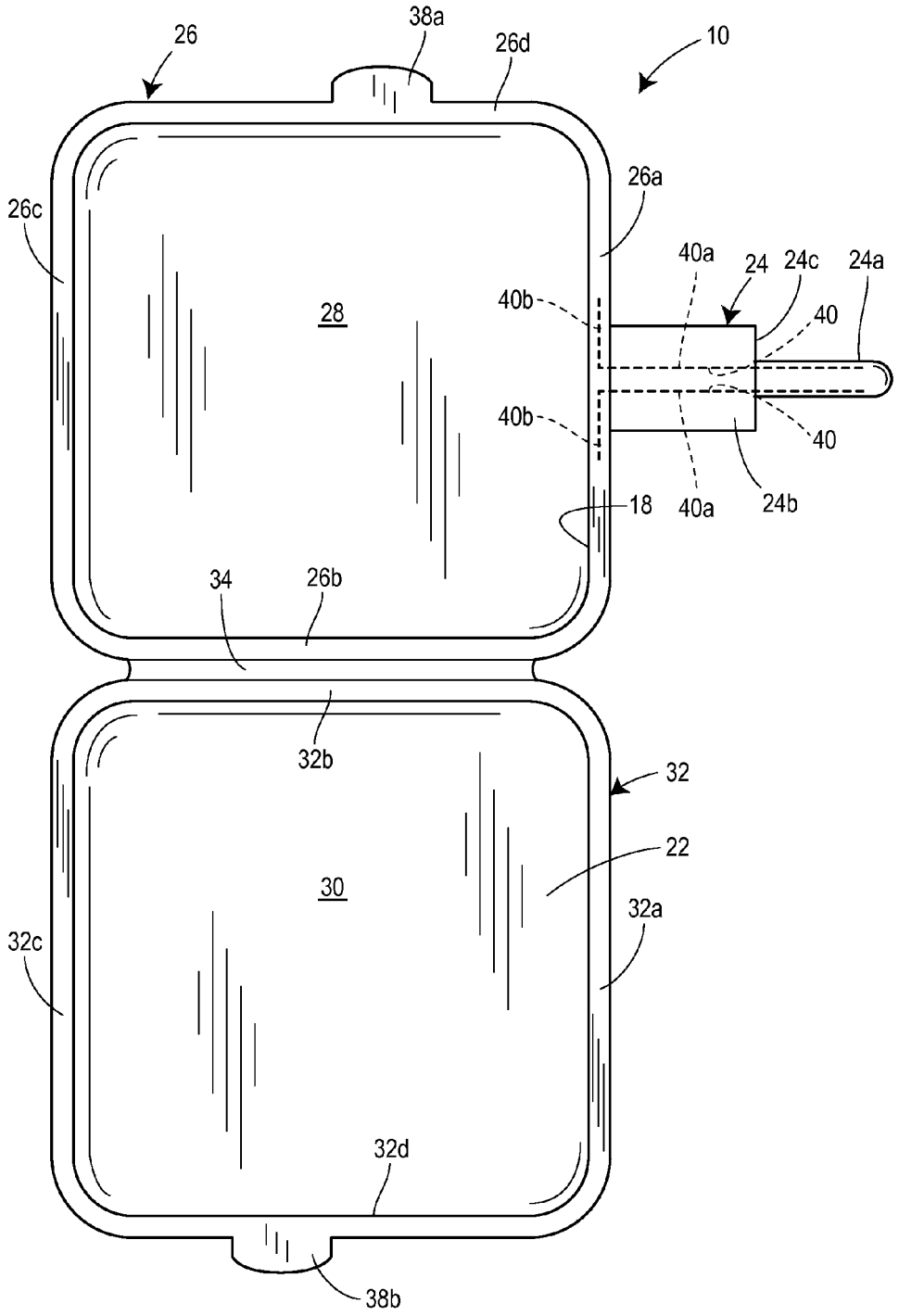
FIG. 3 is a top plan view of the pillbox of FIG. 1 after removal from the cellular phone and in an open position.

In the illustrations given, and with reference first to FIG. 1, the reference numeral 10 designates generally a pillbox for a cellular phone 12 having a port or socket 14 (see specifically FIG. 2B). The pillbox 10 includes a body portion 16, which may comprise a container having an opening 18 through which one or more pills, e.g., 20*a* and 20*b* can be placed and defining an internal volume for receiving the pills therein. The pillbox 10 also comprises a closure portion 22, which may comprise a cover member or lid for opening and closing the container 16. The cover member or lid 22 may be closed after the one or more pills, e.g., 20*a* and 20*b*, have been placed through the opening 18 in the container 16 and received in the internal volume defined by the container 16. As best shown in FIGS. 2A and 3, an attachment portion 24, which may comprise a projection extending from the container 16, is provided for insertion into the port or socket 14 of the cellular phone 12 (see FIG. 1).

More specifically, the projection 24 will be seen to extend from the container 16 for insertion into the port or socket 14 which makes it suitable for safely and effectively transporting the container 16 and the pills, e.g., 20*a* and 20*b*, contained therein with the cellular phone 12 when a patient is away from home (see FIGS. 2A and 2B). As shown in FIGS. 2A and 3, the projection 24 may comprise an insertable portion 24*a* having a first diameter and a bridge portion 24*b* between the insertable portion 24*a* and the body portion 16 having a second, larger diameter. With this arrangement, a shoulder 24*c* is defined at the juncture of the insertable portion 24*a* and the bridge portion 24*b* which acts as a stop to limit the extent to which the insertable portion can be advanced into the port or socket 14 (see FIG. 1).

The container 16 has a side wall generally designated 26 and a bottom wall 28 and the projection 24 extends from the side wall 26 of the container 16. The side wall 26 comprises four side wall segments 26*a*, 26*b*, 26*c*, 26*d*, and the projection 24 extends from one of the side wall segments, e.g., segment 26*a*. The lid 22 has a top wall 30 and a side wall generally designated 32 for closing the container 16 by engagement with the side wall 26 of the container 16. As shown in FIG. 3, a living hinge 34 operatively connects the side walls 26 and 32 of the container 16 and the lid 22, respectively, for closing and opening the container 16.

As will be appreciated, the living hinge 34 comprises a thin flexible hinge which is formed during the molding process of the same material as the container 16 and the lid 22 which it connects.

In the same manner as the container 16, the side wall 32 of the lid 22 may comprise four side wall segments 32*a*, 32*b*, 32*c*, 32*d* and the confronting edges of the respective side wall segments 26*a*, 32*a*; 26*b*, 32*b*; 26*c*, 32*c*; 26*d*, 32*d* may be aligned for contact when the pillbox 10 is in a closed position to ensure the pills 20*a*, 20*b* remain therein. With this construction, the living hinge 34 which may operatively connect the side walls 26 and 32 of the container 16 and the lid 22 by forming it during the molding process to join the corresponding side wall segments 26*b*, 32*b* as best illustrated in FIG. 3.

The medication pillbox 10 including the container 16, lid 22 and projection 24 is preferably molded of a food-safe plastic material to be generally rectangular in shape and the projection 24 is generally cylindrical in shape for insertion into the port or socket 14 on the peripheral edge 36 of the cellular phone 12 normally provided for receiving a jack on an accessory item such as ear buds although other materials, shapes and sizes can be selected.

Referring to FIGS. 2A and 3, the pillbox 10 may include a finger latch generally designated 38 operatively associated with the side walls 26 and 32 of the container 16 and the lid 22, respectively. The finger latch 38 may comprise latch elements 38*a* and 38*b* on corresponding side wall segments 26*d* and 32*d* opposite the living hinge 34 that snap into engagement when the side wall segments 26*a*, 32*a*; 26*b*, 32*b*; 26*c*, 32*c*; 26*d*, 32*d* are moved from the fully open position shown in FIG. 3 to the fully closed position in releasable engagement with one another as will be appreciated from FIG. 2A. After pills such as 20*a* and 20*b* have been placed into the container 16 (FIG. 1), the pillbox lid 22 can be moved to the closed position (FIG. 2A) with the latch elements 38*a* and 38*b* snapped into engagement.

While the pillbox 10 has been illustrated with a finger latch 38, it will be appreciated that various other known structures for maintaining a container and lid in a closed position can be utilized such as a detent or an interference frictional fit between mating side walls of the container and the lid when they are in a closed position to name just a few As will be appreciated by referring to FIGS. 2A and 2B, once the latch elements 38*a* and 38*b* have been snapped into engagement the pillbox 10 is ready to be operatively associated with the cellular phone 12 by removably inserting the projection 24 into the port or socket 14 so the pillbox is positioned as illustrated in FIG. 1.

In an exemplary embodiment, the container 16 and the lid 22 have a combined thickness in the closed position approximately the same as the thickness of the cellular phone 12. Also, in an exemplary embodiment, the container 16 and the lid 22 preferably are formed to have a length in the direction of the peripheral edge 36 of the cellular phone 12 that is no greater than the length of the peripheral edge. In the illustrated embodiment, the container 16 and the lid 22 have a length in the direction of the peripheral edge 36 of the cellular phone 12 that is no greater than half the length of the peripheral edge.

Referring specifically to FIG. 3, the pillbox 10 may include at least one L-shaped projection reinforcing member 40 having one leg 40*a* molded into the projection 24 and another leg 40*b* molded into the side wall segment 26*a* from which the projection extends from the container 16. The provision of one or more L-shaped projection reinforcing members 40 assists in preventing the projection 24 from inadvertently breaking off in the port or socket 14 should the cellular phone 12 be dropped or mishandled. In the illustrated embodiment, two L-shaped projection reinforcing members 40 are provided, each having a first leg 40*a* in the projection 24 and each having a second leg 40*b* oppositely extending within the side wall segment 26*a* from which the projection 24 extends from the container 16.

By providing one or more reinforcing members 40 having a first leg 40*a* in the projection 24 and a second leg 40*b* generally perpendicular to the first leg 40*a*, it facilitates the ability to remove the projection 24 from the port or socket 14 even if it breaks off deep inside the port or socket 14 because the second leg 40*b* will be located outside the port or socket 14 lying along the peripheral edge 36 of the cellular phone 12 where it can easily be grasped to remove the broken projection 24 from the cellular phone 12.

In the embodiment illustrated in FIGS. 1, 2A and 3, the pillbox 10 may be molded of polypropylene to have overall width and height dimensions for both the container 16 and the lid 22 of approximately 1"×1". Further, the container 16 and the lid 22 may be molded such that the thickness of the pillbox when the container 16 and the lid 22 are in the closed position is about 0.5" to roughly approximate the thickness of many cellular phones.

With regard to the projection 24, it is preferably molded of polypropylene with one or more internally disposed metal projection reinforcing members as illustrated in FIG. 3, but the projection 24 could alternatively be formed of metal generally similar to a jack on an accessory item such as ear buds in which case the metal projection should be polarized in order to avoid damage to the output from the port or socket 14 of the cellular phone 12.

Because of the small size an inexpensive materials required for the pillbox 10, it can be molded in very large quantities a low expense in molds that will last for hundreds of thousands of shots over a period of anywhere from 3-10 years making the pillbox a low cost mass distributed item for the multitudes of purchasers who carry a cellular phone and are required to take medication on a regular basis.

Thus, the pillbox 10 provides a unique new manner for patients who frequently leave home to a have their medication available so it can be taken at the prescribed time without having to carry a large pill organizer. If desired, the patient will have the ability to remind themselves if there is a need for the medication to be taken at a specific time by, e.g., setting an alarm, entering a calendar item, or posting a reminder using one or more of the icons 42*a*, 42*b*, etc. on most smart phones. Thus, not only does the pillbox 10 provide a convenient manner of transporting medication for patients having mobility, but operatively associating it with a cellular phone provides still additional advantages to the patient.

Although the foregoing sets forth a detailed description of several different embodiments, it is to be understood that the scope of the disclosure is defined by the words of the claims set forth below. The detailed description is to be construed as exemplary only and does not describe every possible embodiment and feature because it would be impractical, if not impossible to describe every possible embodiment and feature. It is also to be understood that numerous alternative embodiments could be implemented using current technology or technology hereinafter developed which would still fall within the scope of the claims.

Thus, many modifications and variations may be made in the techniques and structures described and illustrated herein without departing from the spirit and scope of the claims set forth below and, accordingly, it is to be understood that the techniques and structures described herein are merely illustrative and not limiting upon the true spirit and scope of the claims.

What is claimed is:

1. A pillbox for a cellular phone having a port, comprising:

a body portion defined by a side wall for holding one or more pills;

a closure portion for closing the body portion;

an attachment portion defined by a projection extending away from the body portion, the projection including a projection reinforcing member, the projection reinforcing member including at least a first leg disposed in the projection and a second leg disposed in the side wall of the body portion.

2. The pillbox of claim 1 wherein the body portion comprises a container having an opening through which the one or more pills can be placed.

3. The pillbox of claim 2 wherein the attachment portion comprises a projection which extends from the container for insertion into the port of the cellular phone.

4. The pillbox of claim 2 wherein the closure portion comprises a cover member to the container for opening and closing the opening in the container.

5. The pillbox of claim 4 including a hinge connecting the cover member to the container for opening and closing the container.

6. The pillbox of claim 1 wherein at least the body portion and the closure portion are molded of a plastic material.

7. A medication pillbox for a cellular phone having a port on a peripheral edge for receiving a jack therein, comprising:

a body portion having an opening through which one or more pills can be placed and defining an internal volume for receiving one or more pills therein;

a closure portion for closing the body portion after one or more pills have been placed through the opening and received in the internal volume defined by the body portion;

the body portion having a side wall and a bottom wall;

an attachment portion defined by a projection extending away from the body portion, the projection including a projection reinforcing member, the projection reinforcing member having at least a first leg disposed in the projection and a second leg disposed in the side wall of the body portion;

the closure portion having a top wall and a side wall for closing the body portion with one or more pills therein by releasable engagement with the side wall of the body portion; and the body portion being molded of a food-safe plastic material.

8. The medication pillbox of claim 7 wherein the body portion is generally rectangular and the attachment portion extending from the body portion is generally cylindrical.

9. The medication pillbox of claim 7 wherein the side wall of the body portion comprises four side wall segments and the attachment portion extends from one of the side wall segments of the body portion.

10. The medication pillbox of claim 9 wherein the side wall of the closure portion comprises four side wall segments and including a living hinge operatively connecting corresponding ones of the side wall segments of the closure portion and the body portion.

11. The medication pillbox of claim 10 including a finger latch operatively associated with the side wall of the body portion and the side wall of the closure portion on corresponding side wall segments opposite to the living hinge.

12. The medication pillbox of claim 7 wherein the body portion and the closure portion have a combined thickness when the body portion is closed of approximately 0.5 inch to roughly approximate the thickness of a cellular phone.

13. The medication pillbox of claim 7 wherein the body portion and the closure portion have a length in the direction of the peripheral edge of the cellular phone that is approximately 1 inch in length and 1 inch in width with the length no greater than half the length of the peripheral edge.

14. The medication pillbox of claim 7 wherein the projection reinforcing member has at least one L-shaped projection reinforcing member.

15. A medication pillbox for a cellular phone having a port on a peripheral edge for receiving a jack therein, comprising:

a generally rectangular body portion having an opening through which one or more pills can be placed and defining an internal volume for receiving one or more pills therein;

a generally rectangular closure portion for closing the body portion after one or more pills have been placed through the opening and received in the internal volume defined by the body portion;

the body portion having four side wall segments and a bottom wall;

an attachment portion defined by a projection extending away from the body portion, the projection including a projection reinforcing member, the projection reinforcing member having at least a first leg disposed in the projection and a second leg disposed in one of the four side wall segments of the body portion the closure portion having a top wall and also having four side wall segments for closing the body portion with one or more pills therein by releasable engagement with corresponding ones of the four side wall segments of the body portion; and the body portion being molded of a food-safe plastic material to be generally rectangular and the attachment portion extending from the body portion being generally cylindrical.

16. The medication pillbox of claim 15 including a living hinge operatively connecting corresponding ones of the side wall segments of the closure portion and the body portion for opening and closing the body portion.

17. The medication pillbox of claim 16 including a finger latch operatively associated with corresponding ones of the side wall segments of the body portion and the closure portion located directly opposite the living hinge.

18. The medication pillbox of claim 15 wherein the body portion and the closure portion have a combined thickness when the body portion is closed of approximately 0.5 inch to roughly approximate the thickness of a cellular phone.

19. The medication pillbox of claim 15 wherein the body portion and the closure portion have a length in the direction of the peripheral edge of the cellular phone that is approximately 1 inch in length and 1 inch in width with the length no greater than half the length of the peripheral edge.

20. The medication pillbox of claim 15 including at least one L-shaped attachment portion reinforcing member having one leg molded into the attachment portion and having another leg molded into the side wall segment from which the attachment portion extends from the body portion.

21. The medication pillbox of claim 15 including two L-shaped attachment portion reinforcing members each having a first leg in the attachment portion and a second oppositely extending leg disposed in the side wall segment from which the attachment portion extends from the body portion.

* * * * *